US005080626A

United States Patent [19]

Maddi

[11] Patent Number: 5,080,626

[45] Date of Patent: Jan. 14, 1992

[54] ANIMAL PUPPET

[76] Inventor: Michael S. Maddi, 148-73 Huxley St., Rosedale, N.Y. 11422

[21] Appl. No.: 716,401

[22] Filed: Jun. 17, 1991

[51] Int. Cl.[5] ..... A63H 3/14; A63H 3/00; A63H 3/36; A63J 19/00

[52] U.S. Cl. ..... 446/329; 446/365; 446/368; 446/390

[58] Field of Search ..... 446/329, 328, 327, 365, 446/366, 367, 368, 370, 373, 382, 384, 390, 278, 26, 27, 374; 8/374

[56] References Cited

U.S. PATENT DOCUMENTS

| | | | |
|---|---|---|---|
| 1,409,411 | 3/1922 | Rogers | 446/374 |
| 2,193,522 | 3/1940 | Ross | 446/374 |
| 2,903,816 | 9/1959 | Fox | 446/27 |
| 3,942,283 | 3/1976 | Rushton | 446/327 |
| 4,196,541 | 4/1980 | Clokey | 446/374 |
| 4,244,142 | 1/1981 | Crawford | 446/329 X |
| 4,824,097 | 4/1989 | Axtell | 446/327 X |
| 4,964,836 | 10/1990 | Kamei | 446/370 X |
| 4,976,646 | 12/1990 | Hull | 446/328 X |

FOREIGN PATENT DOCUMENTS

| | | | |
|---|---|---|---|
| 2387674 | 12/1978 | France | 446/370 |
| 604520 | 3/1960 | Italy | 446/329 |
| 984694 | 3/1965 | United Kingdom | 446/373 |

*Primary Examiner*—David N. Muir

[57] ABSTRACT

A puppet of the type having a flexible elongated neck manipulated through movement from within by the puppeteer's forearm, and the puppet having depending legs adapted to serve as a rest or support for the forearm as well as the puppet's appearance.

2 Claims, 1 Drawing Sheet

ANIMAL PUPPET

The present invention relates generally to hand-manipulated puppets, and more particularly to an improved construction for such a puppet which minimizes hand fatigue of the puppeteer and provides other noteworthy benefits during animation of the puppet.

EXAMPLES OF THE PRIOR ART

Puppets which simulate animals are already well known, including those specifically simulating an animal with a head and neck and contemplating animation movements of the head and neck cause by corresponding movements of the puppeteer's hand and forearm. Example of prior patents with disclosures of such animal puppets in U.S. Pat. No. 2,795,896 issued on June 18, 1957 to Snyder and U.S. Pat. No. 4,244,142 issued on Jan. 13, 1981 to Crawford.

Unlike the within inventive puppet which uses structural features of its construction to support the weight of the forearm of the puppeteer during animation of the puppet, the Crawford patented puppet has no provision for achieving this objective.

In Snyder, the puppet 12 has depending legs 18 and 19, but these legs are not described as being of rigid construction material, and therefore are not capable of functioning as arm-supporting structure, which is the crux of the within inventive puppet.

Broadly, it is an object of the present invention to overcome the foregoing and other shortcomings of the prior art. More particularly, it is and object to provide support of the forearm of the puppeteer during manipulation of the puppet, and thus minimize fatigue, and otherwise contribute to more effective animation of the puppet.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENTS

Figure 1:
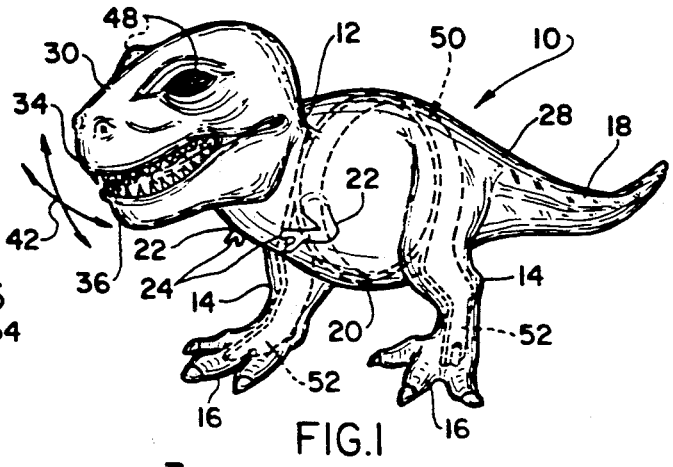
FIG. 1 is a perspective view of the within inventive animal puppet illustrating internal structural features in phantom perspective.
Figure 2:
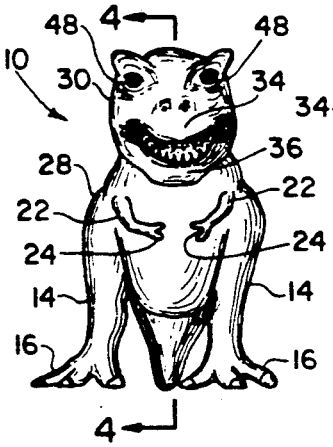
FIG. 2 is a front elevational view of the puppet projected from FIG. 1.
Figure 3:
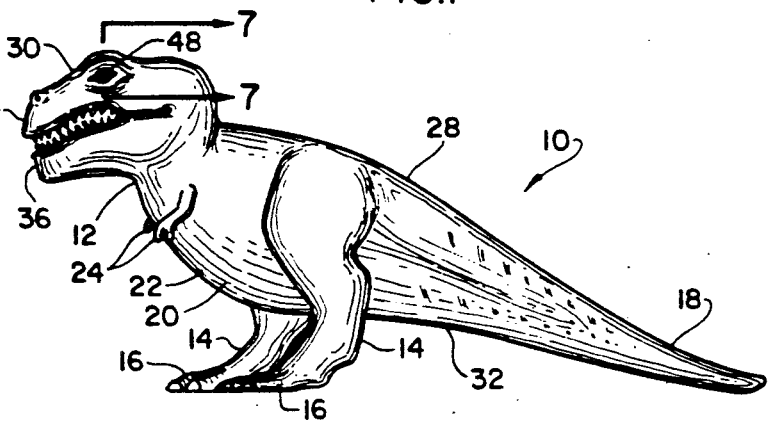
FIG. 3 is a side elevational view of the puppet.

Shown in FIG. 1 is a three dimensional hand-manipulated puppet, generally designated 10, configurated to resemble a type of dinosaur in miniature scale. In particular, the depicted dinosaur will be understood to selected from a carnivorous species of dinosaur which characteristically had a short neck 12 and walked or ran on sturdy hind legs 14 with triple toed feet 16, known as a Tyrannosaurus. This prehistoric reptile had a long, bulky, pointed tail 18 which served as a counterbalance for the heavy neck 12 and body 20. The forelegs 22 were small and weak, terminating in talonlike feet 24 adapted for grasping.

Figure 4:
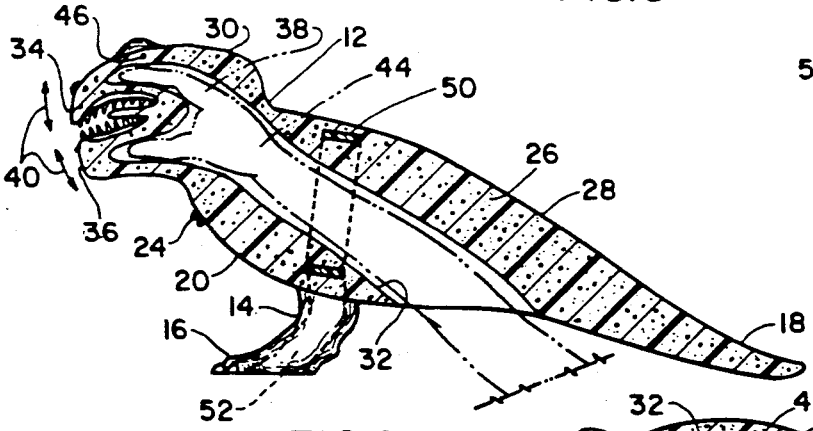
FIG. 4 is a cross sectional view as taken along line 4—4 of FIG. 2.
Figure 6:
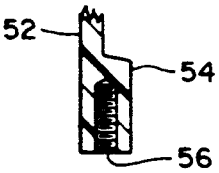
FIG. 6 is a partial, detailed cross sectional view as taken along line 6—6 of FIG. 5.
Figure 7:
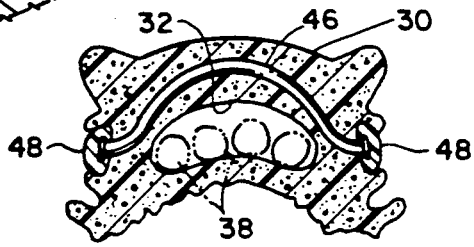
FIG. 7 is a partial cross sectional view as taken along line 7—7 of FIG. 3.

Puppet 10 is preferably molded of a foamed flexible plastic 26, either of Latex construction material or the equivalent, whose surface 28 is made to be stretchably continuous and to resemble the detail contours characteristic of animal skin. The outer simulated skin surface 28 is further air brushed or otherwise decorated for an authentic look. Within the head 30 and body 20, the surface 28 bounds a contiguous arm cavity 32, as best seen in FIG. 4, which is provided to receive in projected relation therein, through an opening 32 (FIG. 4) adjacent the forward edge of the neck cavity or compartment at the end thereof remote from the head 30, the hand and forearm of a puppeteer (shown in phantom perspective in FIG. 4), incident to imparting a degree of puppet animation, particularly to the head 30 and neck 12. Additionally, upper jaw 34 and lower jaw 36 can be moved relative to each other by the puppeteer's or user's hand 38 wihthin head 30 to portray chewing, biting or "talking", as indicated by movement depicting arrows 40. Movement of the entire head 30 of the puppet 10, either vertically or from side to side or in compound movements, as exemplified by movement arrows 42 (FIG. 1) are contemplated being accomplished by corresponding rotation or compound movement of the user's wrist 44. Combined motions such as raising the head 30 and separating jaws 34, 36 might in practice be accompanied by a roaring sound to further contribute to realism in the use of the puppet 10. Molded within head 30 is lateral member 46 to which eyes 48 are securely attached at each end, in keeping with accepted conventional child safety precautions.

Figure 5:
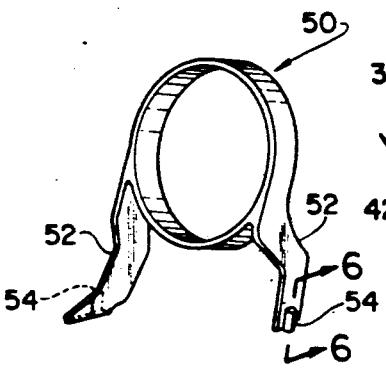
FIG. 5 is a perspective view of an internal structural member removed from within the puppet of FIG. 1 to better illustrate the features thereof.

Although prior art animal puppets also contemplate head and neck movements as just described, these prior art puppet constructions do not contribute to the ease and efficiency of accomplishing these movements while minimizing any fatigue to the puppeteer as might otherwise result from the hand movements necessary to provide this animation. Thus, underlying the present invention is the provision of an internal forearm-supporting operative member as shown in isolated relation in FIG. 5 and generally designated 50 therein, having the specific structural features, and the support movement-imparting functions, now to be described in detail.

Since as already noted, the entire unit 10 is made of a flexible foam plastic 26 and the hand/arm compartment for cavity 32 removes bulk from body 20, it is advisable that the operative member 50, in the specific form of a supporting ring 50 is introduced at molding. Ring 50 is made of molded rigid plastic basically circular in shape and sized to fit about cavity 32 and within the outline of body 20 at the hip area. Ring 50 has, as a significant structural configuration, an inverted U-shape consisting of two spaced apart legs 52 and an upper leg formed by the portion of the circular shape of member 50 connected in spanning relation between the legs 52, and is connected in depending relation from the puppet body so that there is presented a pair of dependent legs 52 located and shaped to comport with the leg/foot posture of the animal represented by the puppet 10. On the lower end of each leg 52 a boss 54 is provided for the proper mounting of ring 50 within the mold cavity when device 10 is being formed. Additionally, should the finished puppet 10 be put on display or mounted on a base, screw holes 56 allow for convenient invisible attachment thereon. Ring 50 ensures that body 20 maintains its semblance or roundness and that legs 14 remain rigid when supporting device 10.

In use, the user works his/her hand 38 within the jaw 34, 36 and head 30 via the hand/arm cavity 32, and then proceeds in a well understood manner to maneuver or urge through movement the device in puppet fashion with appropriate audible accompaniment.

In contrast to, and as patentable advance over known prior art animal puppet devices, the circular portion of the ring of member 50 connected between the legs 52 is, in practice, in an advantageous position beneath, and thus in a supporting position, relative to the forearm of the puppeteer, and thus significantly eases any fatigue that otherwise might occur in the puppeteer's forearm if not supported as just noted. Additionally, in the embodiment of member 50 which includes in addition to an inverted U-shape, a full circular shape which, of course, encircles the forearm of the puppeteer, any movement of the puppeteer's forearm correspondingly moves the circular configuration of member 50 thus imparting animation movements to the puppet 10. For example, if the puppeteer raises his forearm, contact is, of course, made against the upper portion of the circle and the puppet 10 will thus also be raised.

While preferred as a full circle configuration in the upper portion of member 10 for the reason just noted, it is also contemplated that this can be omitted and only the inverted U-shaped bottom of the operative member 50 be provided, since the U-shape will provide the fatigue obviating support that itself is noteworthy.

While the described apparatus for practicing the within invention is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claimed.

What is claimed is:

1. Improvements for a hand-manipulated puppet of the type simulating an animal having a head, neck and body, the improvements comprising said head and neck bounding contiguous internal compartments and said body having an opening in communication with an end of said neck compartment remote from said head for receiving in projected relation therethrough into said contiguous compartments the hand and forearm of a puppeteer incident to manipulating said head and neck in movements, and an inverted U-shaped member comprising of two spaced apart legs, an upper arch and a third leg connected in spanning relation therebetween said spaced apart legs connected in depending relation from said body at a selected location adjacent a forward edge of said opening so that the two spaced apart legs of said U-shape in said depending relation from said body effectively simulate legs of said simulated animal puppet and said upper leg in a spanning relation between said legs is located in a corresponding crossing relation to said neck compartment, whereby said upper leg effectively serves as a support for the forearm of the puppeteer.

2. The improved animal puppet as claimed in claim 1 wherein the forearm-supporting third leg of said member is further extended to form a circle that correspondingly encircles the forearm of the puppeteer, to thereby contribute to assisting the puppeteer in manipulating the animal puppet in movements corresponding to movements of said circle caused by movement of the puppeteer's forearm.

* * * * *